US009080559B2

(12) United States Patent
Pecorari

(10) Patent No.: US 9,080,559 B2
(45) Date of Patent: Jul. 14, 2015

(54) RADIAL HYDRAULIC MOTOR

(75) Inventor: Pierce-lestino Pecorari, Modena (IT)

(73) Assignee: R. & D. S.R.L., Modena (IT)

( * ) Notice: Subject to any disclaimer, the term of this patent is extended or adjusted under 35 U.S.C. 154(b) by 359 days.

(21) Appl. No.: 13/636,654

(22) PCT Filed: Mar. 23, 2011

(86) PCT No.: PCT/IT2011/000087
§ 371 (c)(1),
(2), (4) Date: Nov. 26, 2012

(87) PCT Pub. No.: WO2011/117904
PCT Pub. Date: Sep. 29, 2011

(65) Prior Publication Data

US 2013/0064691 A1 Mar. 14, 2013

(30) Foreign Application Priority Data

Mar. 23, 2010 (IT) ..... MO2010A0080
Nov. 10, 2010 (IT) ..... MO2010A0321

(51) Int. Cl.
*F01B 1/06* (2006.01)
*F04B 1/00* (2006.01)
(Continued)

(52) U.S. Cl.
CPC . *F04B 1/00* (2013.01); *F01B 1/062* (2013.01); *F01B 1/0655* (2013.01); *F01B 15/005* (2013.01); *F04B 1/053* (2013.01)

(58) Field of Classification Search
CPC .... F04B 1/0658; F04B 1/0421; F04B 1/0426; F04B 1/053; F04B 1/0655
USPC ..... 91/491; 92/72, 129, 169.2; 417/273
See application file for complete search history.

(56) References Cited

U.S. PATENT DOCUMENTS 2,621,607 A * 12/1952 Trapp ..... 417/273
2,642,748 A * 6/1953 Widmer ..... 74/49
(Continued)

FOREIGN PATENT DOCUMENTS

DE 359 543 C 9/1922
EP 0 172 076 A1 2/1986
(Continued)

OTHER PUBLICATIONS

PCT International Search Report dated Aug. 17, 2011.
(Continued)

*Primary Examiner* — Charles Freay
(74) *Attorney, Agent, or Firm* — McGinn IP Law Group, PLLC

(57) ABSTRACT

A radial cylinder hydraulic motor includes oscillating cylinders, in proximity to the outer skirt to the crown or star of cylinder-piston groups; the pistons of the said groups slide on a crankshaft or eccentric shaft, or on interposed organs concentric to it, and create alternate motion in the oscillating cylinders. A respective surface of oscillation for each cylinder of the said groups, in proximity to the outer skirt, is constituted by a portion of cylindrical surface with axial direction parallel to the axis of rotation of the crankshaft or eccentric shaft and positioned in the part of skirt including the diametral plane of lying of the said crown or star of radial cylinders. A contact between the cylindrical support surface of a bottom plate of each cylinder on the portion of cylindrical surface of oscillation happens because of the thrust created by the radial thrust devices which act on at least one side of the said cylinders and the sides of cylinders are placed against plane surfaces of the sliding walls that are parallel to the diametral plane of said crown or star of cylinder-piston groups.

10 Claims, 7 Drawing Sheets

(51) Int. Cl.
*F01B 15/00* (2006.01)
*F04B 1/053* (2006.01)

(56) References Cited

U.S. PATENT DOCUMENTS

| | | | | | |
|---|---|---|---|---|---|
| 3,656,407 | A | * | 4/1972 | Hause | 91/490 |
| 3,695,146 | A | | 10/1972 | Orshansky, Jr. | |
| 3,945,766 | A | * | 3/1976 | Gelon | 417/273 |
| 4,018,139 | A | | 4/1977 | Landreau | |
| 4,223,595 | A | * | 9/1980 | Ortelli | 92/72 |
| 4,609,128 | A | | 9/1986 | Amellal | |
| 4,683,806 | A | * | 8/1987 | Ryzner | 92/66 |
| 5,967,018 | A | * | 10/1999 | Breveglieri | 92/12.1 |
| 7,258,057 | B2 | | 8/2007 | Nagler et al. | |
| 8,206,130 | B2 | | 6/2012 | Pecorari et al. | |
| 2009/0301291 | A1 | * | 12/2009 | Pecorari et al. | 91/491 |

FOREIGN PATENT DOCUMENTS

| | | | |
|---|---|---|---|
| FR | 2 822 199 | A1 | 9/2002 |
| FR | 364 549 | A | 8/2006 |
| GB | 1 520 912 | A | 8/1978 |
| WO | WO 03/078797 | A1 | 9/2003 |
| WO | WO 2007/122644 | A1 | 11/2007 |

OTHER PUBLICATIONS

International Preliminary Report on Patentability dated Nov. 16, 2011.

* cited by examiner

RADIAL HYDRAULIC MOTOR

FIELD OF APPLICATION

The present invention is an optimised radial cylinder hydraulic motor, that is a hydraulic device of the type which is well-known in the field with cylinders arranged in a star shape which all act on the same eccentricity or crankshaft of the motor axle. The hydraulic motor which is the described here presents optimized characteristics in comparison with others in this technological field and reaches a significantly improved technological and economic performance.

PRIOR ART

In this technological field, there are various types of radial cylinder hydraulic motors with cylinders arranged in a star shape. These are in particular hydraulic motors where a single cylinder oscillates around an axis or point, close to the outer diameter of the skirt of the hydraulic motor, in order to carry out the oscillation required by the crankshaft with which it is in contact in order to generate rotary motion. This oscillation is necessary insomuch as the cylinder piston complex carries out the functions of "piston rod", or a crank for rotary thrust, which oscillates to follow the evolution of the pivot of the crank or eccentricity of the drive motor.

In this technological field, there are two main ways of making these hydraulic motors, as stated above.

The first way is to support the cylinder during oscillation using lateral trunnions, positioned on an axis of oscillation parallel to the axis of the crankshaft and close to the outer skirt of the motor; they allow the passage of hydraulic oil through one of them and therefore the part of the cylinder that creates most obstruction, the jacket and its outer skirt, can be positioned far from the crank. In this way, the motor has greater engine displacement without changing the size of the engine. The respective piston is positioned so that it moves on the external surface of the crank or eccentric shaft, or it can work indirectly with interposed concentric organs, which rotate with it.

The second way of oscillation of the cylinder-piston complex in the said hydraulic motor is to support the cylinder-piston complex on a spherical surface, for every cylinder. This surface is positioned in proximity to the outer diameter of the skirt of the hydraulic motor. In this second way, the sliding part on the crank or eccentricity of the crankshaft is positioned, optionally, on an annular spherical surface, in an axial direction in relation to the shaft. Therefore, it presents the sliding surface with a preferential plane of lying of the cylinder-piston complex, which obviously corresponds to the plane of lying of the spherical surface present at the most outer diameter in order to support the thrust generated by the cylinder or piston. In fact, there are some well-known versions of the motor in the field in which the piston is positioned close to the outer diameter and the jacket and its skirt are positioned in proximity to the inner diameter, that is close to the diameter of oscillation on the eccentricity or crankshaft. However, this version creates clear disadvantages in terms of their dimensions.

It is well-known that the first way of oscillation of the cylinder-piston complex presents the critical point on the surfaces of oscillation of the trunnions. This is because the thrusts generated by the hydraulic liquid in the cylinder are transmitted to the skirt by way of the said trunnions and at the same time at least one trunnion must be hollow to allow the passage of hydraulic liquid. However, the construction of the coupling of the trunnions with the skirt for oscillation is very complex and costly and the trunnions often turn out to be weak during performance and in supporting the thrusts generated. Furthermore, in hydraulic motors of this type, which have variable engine displacement at minimum values, which are not zero, the amplitude of oscillation in the trunnions in significantly reduced, while the thrusts on the trunnions do not reduce. This limits the value of the thrusts at lower engine displacements.

In the second way of oscillation of the cylinder-piston complex, the passage of the hydraulic liquid from and towards the cylinder, happens from the exterior of the spherical surface of oscillation. It is carried out by increasing as much as necessary the diameter of the skirt or its dimension. This does not allow the dimensions of the hydraulic motor to be contained and limited. Therefore, the dimensions of the hydraulic motor become more evident and detrimental, especially when the plan is to have large dimensions in order to be able to have greater engine displacements and greater quantities of hydraulic liquid that cross the motor. In this second way, the speed of rotation and therefore the oscillation of the cylinder-piston complex is also limited by the whiplash that is generated at the bottom dead centre, between the piston and the cylinder, when the motor turns at increased speeds of rotation; the greater mass of the jacket or skirt of the cylinder undergoes a sudden inversion of acceleration at the passage of the said bottom dead centre, which then stress the sliding coupling between the piston and the jacket, in a limited point, with forces of inertia lying on the plane of oscillation of the cylinder-piston complex. This creates the tendency of the piston to stick during sliding in the jacket.

Finally, in this technological field there are also hydraulic motors with several cylinder-piston stars side by side on the same crankshaft. These types of motors are not easy if a single distributor is used, due to the arrangement of the connecting channels. The dimension of the said channels is limited if a reduced radial dimension is desired.

In fact, a notable quality of radial cylinder hydraulic motors is that of having a large engine displacement in its dimensions, i.e. it produces greater torque without the hydraulic liquid working at higher pressures and at the same time can function at higher speeds of rotation achieving a maximum flexibility which was not possible before. This allows for a better performance than other types of hydraulic motor as is well known. Further limits of the existing technology are the need to increase the openings and channels for supply and/or discharge of hydraulic liquid which is not possible without increasing the dimensions; the need to reduce the length of the said channels in order to reduce the clearance volume which generates sound due to the constant variation of pressure of the column of liquid contained in them; the need to reduce the outer dimensions of the motor equal to the engine displacement and mechanical performance, which would make it more desirable for users in that they could insert it into spaces and dimensions that are much smaller.

Therefore, the existing technology can be significantly improved with regards to realizing an optimized radial hydraulic motor, with oscillating cylinders, which overcomes the disadvantages above making the reduction of the dimensions and of the masses concerned more practical, easy and functional.

The technical problem that is the basis of the present invention is that of having an optimized radial hydraulic motor with oscillating cylinders, in which the cylinder-piston group is housed in the motor body in the simplest and most economical way possible i.e. the work needed to house the group must be very economical. In addition to this improved method of housing, the radial cylinder hydraulic motor with oscillating cylinders must also be able to offer the technological advantages for which it is known.

A further and not final aim of the present invention is that of achieving an optimized radial hydraulic motor with oscillating cylinders in which the reduction of the dimensions with the same engine displacement of the motor, or vice versa with the same dimensions with an increased engine displacement, also makes it possible to reduce the clearance volumes present in the passages for supplying and discharging from the cylinders.

Finally, a further part of the technical problem explained above regards achieving an optimized radial hydraulic motor with oscillating cylinders in which the section of the passages for supplying and discharging from the cylinders can be increased in order to make the passage of hydraulic liquid from the installation to the cylinders and vice versa easier and more effective. The objective is to have greater flow rates than those that have been achieved in the existing technology.

SUMMARY OF THE INVENTION

This problem is solved, according to the present invention, by a radial cylinder hydraulic motor, comprising: oscillating cylinders in proximity to the outer skirt to the crown or star of cylinder-piston groups; the pistons of the said groups slide on a crankshaft or eccentric shaft, or on interposed organs concentric to it, and create alternate motion in the oscillating cylinders; it is characterized in that it presents the respective surface of oscillation for each cylinder of the said groups, in proximity to the outer skirt, constituted by a portion of cylindrical surface with axial direction parallel to the axis of rotation of the crankshaft or eccentric shaft and positioned in the part of skirt including the diametral plane of lying of the said crown or star of radial cylinders; furthermore the contact between the cylindrical support surface of a bottom plate of each cylinder on the portion of cylindrical surface of oscillation happens because of the thrust created by the radial thrust devices which act on at least one side of the said cylinder.

In a further and advantageous form of construction: the portion of cylindrical surface of oscillation of the cylinder is made though mechanical production, in proximity to the inner diameter, directly in the same skirt.

Furthermore, in a specific version, the portion of cylindrical surface of oscillation of the cylinder is made on an inserted mechanical organ, in proximity to the inner diameter of the same skirt.

In a further form of construction: the portion of cylindrical surface of oscillation of the cylinder, made on an inserted mechanical organ, is connected to the skirt either in parts or lateral caps of the hydraulic motor in a detachable way.

Furthermore, in another form of construction, which is very beneficial, the axis of curvature of the portion of cylindrical surface of oscillation of each cylinder is in a position external to the outer diameter of the skirt.

In a further form of construction: the axis of curvature of the portion of cylindrical surface of oscillation of each cylinder is in an internal position, but next to the outer diameter of the skirt.

Furthermore, in a specific version, the thrust devices are constituted by a ring equipped with flaps which are curved, in relation to the axis of curvature of the portion of cylindrical surface of oscillation of each cylinder, according to a respective radius of curvature on the said thrust devices.

In a further form of construction, the thrust devices on the cylinder, for contact on the portion of cylindrical surface of oscillation, are positioned in a curved indent according to a respective radius of curvature in relation to the axis of curvature of the said portion of cylindrical surface of oscillation of the cylinder-piston group.

Furthermore, in a more beneficial form of construction, the thrust devices on the cylinder, for contact on the portion of cylindrical surface of oscillation, are constituted by a ring which presses into a curved step according to a respective radius of curvature in relation to the axis of curvature of the said portion of cylindrical surface of oscillation of the cylinder-piston group.

Furthermore, in a preferred form of construction, the passage of hydraulic liquid to and from the oscillating radial cylinder in order to achieve the supply and discharge from the cylinder, happens though at least one lateral outer surface on the side of the oscillating cylinder from and towards a supply channel on the body or lateral cover of the hydraulic motor; a seal ring equipped with at least one contact surface, which is resistant to abrasion on the surface of the sliding wall, is interposed between the lateral surfaces in contact for the passage of the liquid under pressure.

Furthermore, in a specific variation of construction, in an external lateral surface parallel to and opposite the lateral surface external to the oscillating cylinder crossed by the liquid supply, there is a compensation opening for the thrust, supplied by the liquid under pressure in the oscillating cylinder. Around this is a seal ring equipped with at least one contact surface that is resistant to abrasion on the surface of the wall used for sliding, in addition it is placed between the lateral surfaces in contact for the passage of liquid under pressure through the compensation opening.

Furthermore, in a preferred form of construction, the surface of action of the pressure in the said compensation opening for the thrust or in one of its niches made in the lateral sliding surface is slightly greater than the surface for the passage of liquid under pressure in the supply hole present in the radial oscillating cylinder.

Finally, the seal ring in sliding contact between a lateral surface external to the oscillating radial cylinder and a lateral sliding surface of the cylinder is constituted by an arrangement of parts in which: a metal ring functions as the surface that is resistant to abrasion, present on the side of the retainer in contact with the sliding surface of the seal ring; a ring made from soft, flexible material is interposed between the metal ring and the seat or niche in which the seal ring is housed; an anti-extrusion ring is placed between the metallic ring and the soft, flexible ring in order to avoid its discharge due to the pressure of the liquid during operation.

The characteristics and the advantages of the present invention, an optimized radial hydraulic motor with oscillating cylinders, will be shown in the description which follows of an example provided as a guide which is not restrictive, with reference to the seven drawings attached.

DETAILED DESCRIPTION OF A PREFERRED EMBODIMENT OF THE INVENTION

Figure 1:
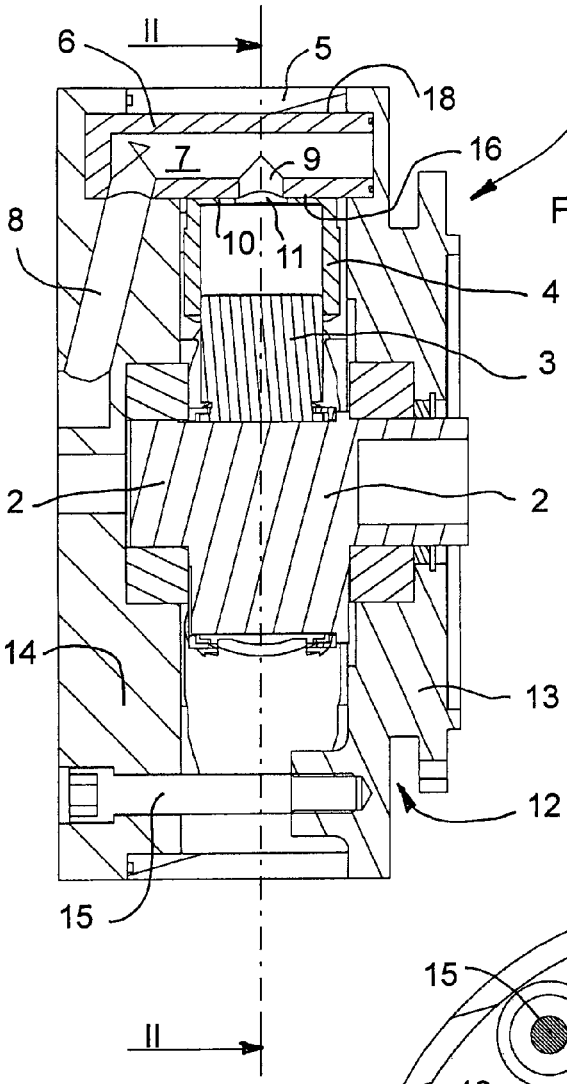
FIG. 1 represents a schematic view of a simplified axial section of a first form of the optimized radial hydraulic motor with oscillating cylinders, according to the invention. The radius of oscillation, at the outer diameter of the crown of cylinder, presents the centre of oscillation which is internal to the skirt of the motor.
Figure 2:
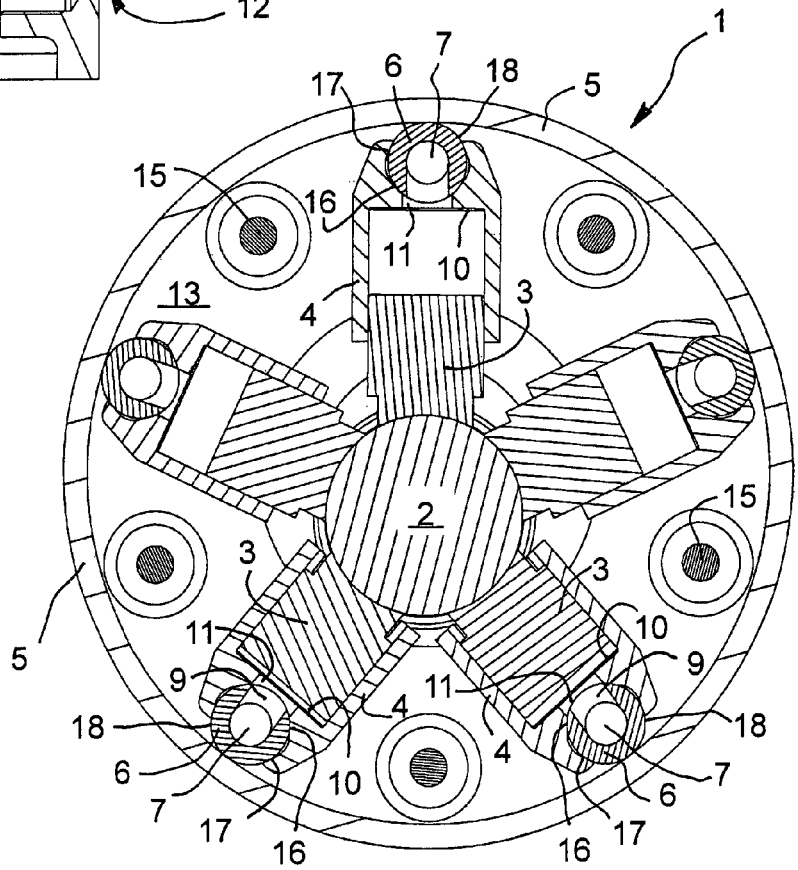
FIG. 2 represents a schematic view of a simplified diametral section II-II of the hydraulic motor in FIG. 1.

In FIGS. 1 and 2 a first radial cylinder hydraulic motor 1 with oscillating cylinders can be seen. The pistons 3 are made to slide on a crankshaft 2 and they carry out alternate motion in the cylinders 4, which are in turn made to oscillate close to the outer diameter of the skirt 5 of the motor 1, by means of a respective sleeve 6, which is fixed to the skirt 5. The sleeve is equipped with an internal hole 7 to complete a communication channel 8 between a distributor of hydraulic liquid, which is not represented here, and the opening 9 for the fluid connection between the hole 7 and the cylinder below 4; in the bottom plate 10 of the cylinder 4, there is an eyelet 11, which allows the complete passage of liquid even when the cylinder is tilted. The body 12 of the motor 1 is completed with two covers 13, on the side where the crankshaft 2 comes out, and 14 with channels 8 for the distribution on the side of the distributor not represented here. The covers are sealed with screws 15 on the outer skirt 5 and the sleeves 6 for the oscillating cylinder piston groups.

Each cylinder 4 presents, as clearly visible in FIG. 2, a cylindrical support surface 16, in the part where there is contact between the bottom plate 10 and the sleeve 6, near the opening 9 and a cylindrical contact surface 17, in a more external radial position towards the skirt 5 in order to generate undercut and maintain contact between the support surface 16, on the outer diameter 18 of the sleeve 6, during the oscillating motion of the cylinder 4 and the relative alternate motion of the piston 3 inside it, even though during motion the cylinder with no pressure inside would normally detach from the portion of cylindrical surface of oscillation made up by the said outer diameter 18 of the sleeve 6. The portion of cylindrical surface of oscillation of the cylinder 4 is constituted by the part of outer diameter 18 of the sleeve 6 in contact with the cylindrical support surface 16.

Figure 3:
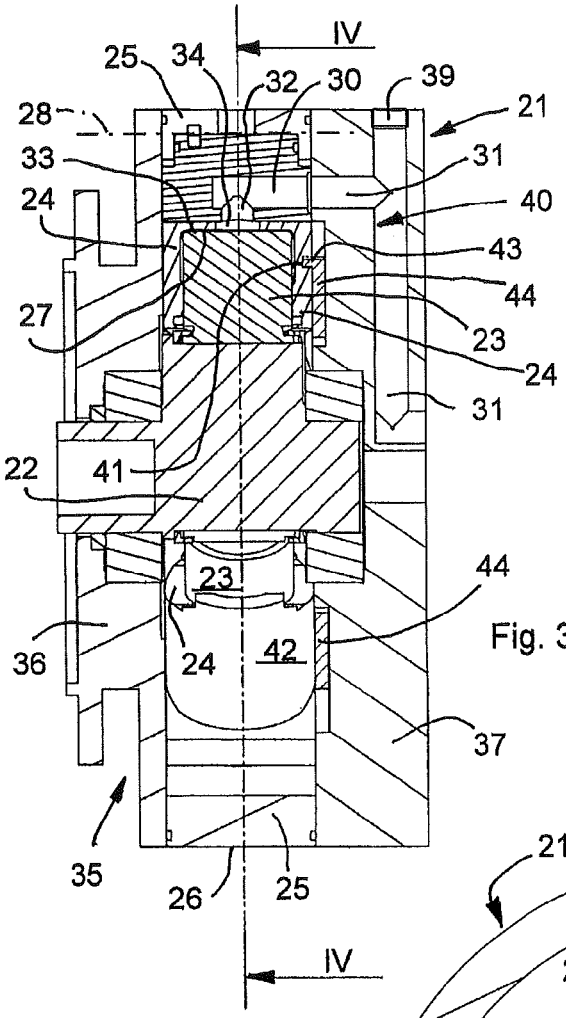
FIG. 3 represents a schematic view of a simplified axial section of a second from of an optimized radial hydraulic motor with oscillating cylinders, according to the invention. The radius of oscillation at the outer diameter of the crown of cylinders presents the centre of oscillation close to the diameter of the skirt of the motor body and the surface of oscillation which is inserted to the interior of the skirt.
Figure 4:
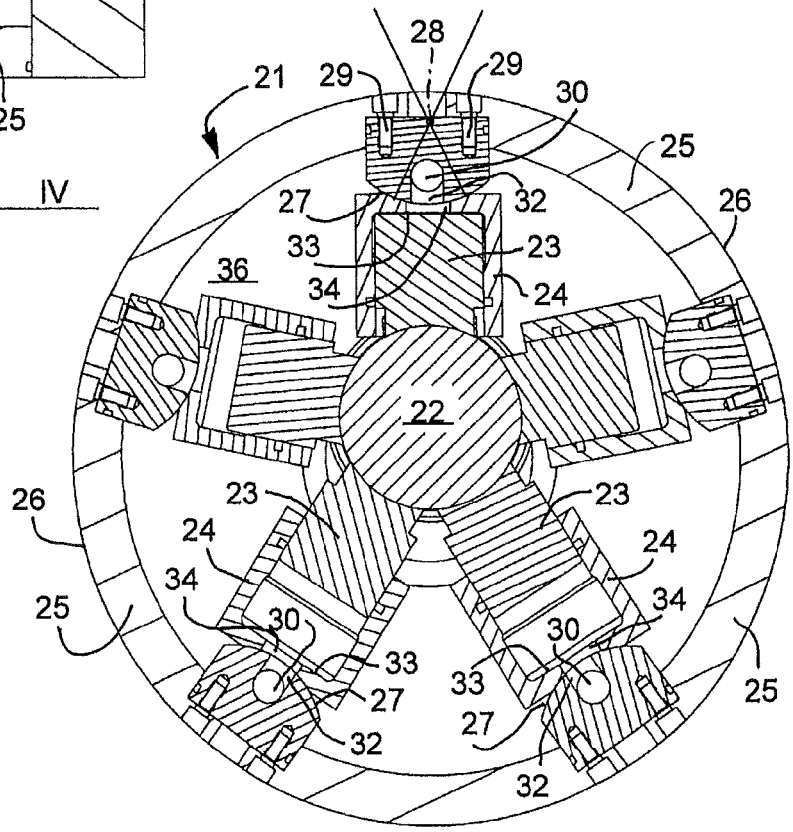
FIG. 4 represents a schematic view of a simplified diametral section IV-IV of the hydraulic motor in FIG. 3.

In FIGS. 3 and 4, a second radial cylinder hydraulic motor 21 with oscillating cylinders can be seen. The pistons 23 are made to slide on a crankshaft 22 and they carry out alternate motion in the cylinders 24, which are in turn made to oscillate close to the outer diameter 26 of the skirt 25 of the motor 21. They are on an inserted cylindrical surface 27 having an axis of curvature 28 close to the outer diameter 26 of the skirt 25. The inserted cylindrical surface 27 is fixed to the skirt 25 by means of connection devices 29, i.e. with screws as represented here, and it is equipped with an axial internal hole 30 to complete a communication channel 31 between a distributor of hydraulic liquid, not represented here, and the opening 32 for fluid connection between the internal hole 30 and the cylinder 24 below; in the bottom plate 33 of the cylinder 24, there is an eyelet 34, which allows the complete passage of liquid even when the cylinder is tilted to the opening 32. The body 35 of the motor 21 is completed with two covers 36, on the side where the crankshaft 22 comes out, and 37 with channels 31 for the distribution on the side of the distributor, not represented here. The covers are sealed with screws on the outer skirt 25 with the inserted surfaces 27 for the oscillating cylinder piston groups. The channels 31 are made radially and/or axially, in correspondence with the respective inner axial hole 30 of the inserted cylindrical surface 27, in the cover 37. Holes created during processing can be sealed with unused caps 39, as is well-known in the field.

Figure 13:
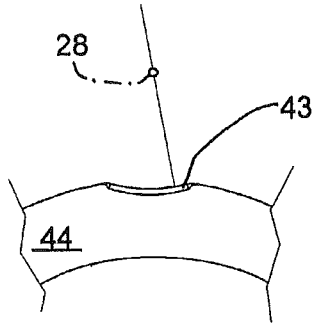
FIG. 13 is a side view of a part of a thrust ring of the cylinders against the cylindrical surfaces of oscillation close to the outer skirt of a hydraulic motor of FIG. 3 or 5.

As can be clearly seen in FIG. 3, each cylinder 24 presents thrust devices on the cylinder, indicated as 40, in order to maintain contact between the cylinder and the inserted cylindrical surface 27. These act on the cylinder by means of a curved indent 41, with a curvature coincidental with the axis of curvature 28 and positioned on the outer side 42 of the same cylinder; contact between the bottom plate 33 and the inserted cylindrical surface 27 is maintained by inserting a curved flap into the said curved indent 41 of each cylinder. A curved flap 43 is of the same shape as the curved indent and it is supported by a ring 44 in order to maintain the respective cylinder 24 pushed up against the inserted cylindrical surface 27 during the oscillating motion of the cylinder 24 and the relative alternate motion of the piston 23 inside it, even though during motion the cylinder with no pressure inside would normally detach from the portion of cylindrical surface of oscillation made up by the said inserted cylindrical surface 27. In FIG. 13 a side view of a part of the ring 44 and a flap 43 can be seen. The flap is folded into the curvature required by the position of the axis of curvature 28 in order to push the cylinder 24 against the inserted cylindrical surface 27.

Figure 5:
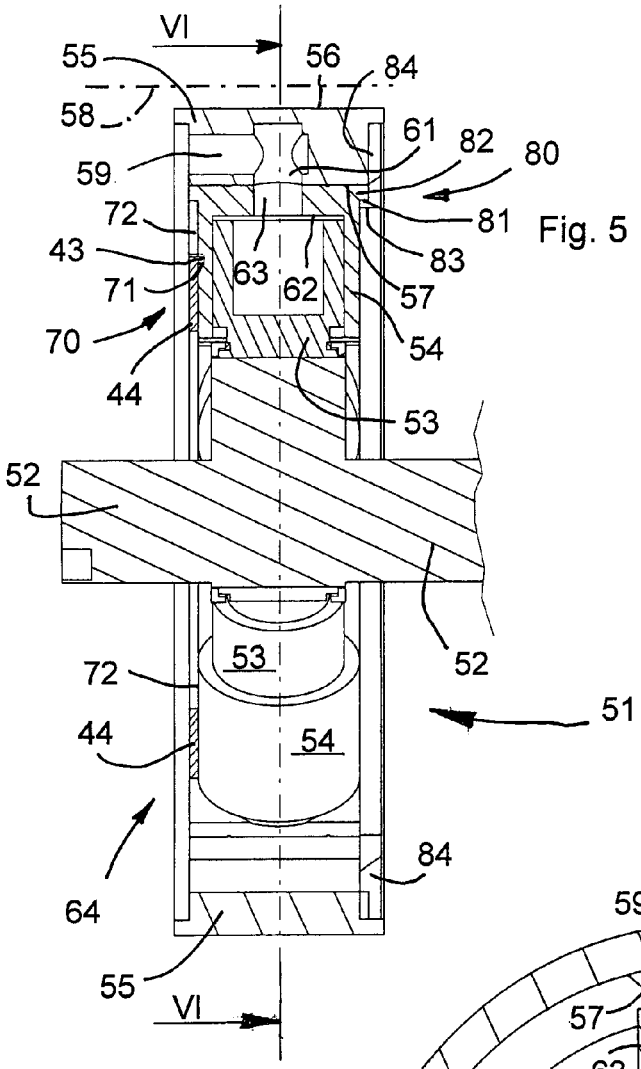
FIG. 5 represents a schematic view of a simplified axial section of a third from of an optimized radial hydraulic motor with oscillating cylinders, according to the invention. The radius of oscillation at the outer diameter of the crown of cylinders presents the centre of oscillation external to the skirt of the body motor and the surface of oscillation which is constructed in pieces at the interior of the skirt.
Figure 6:
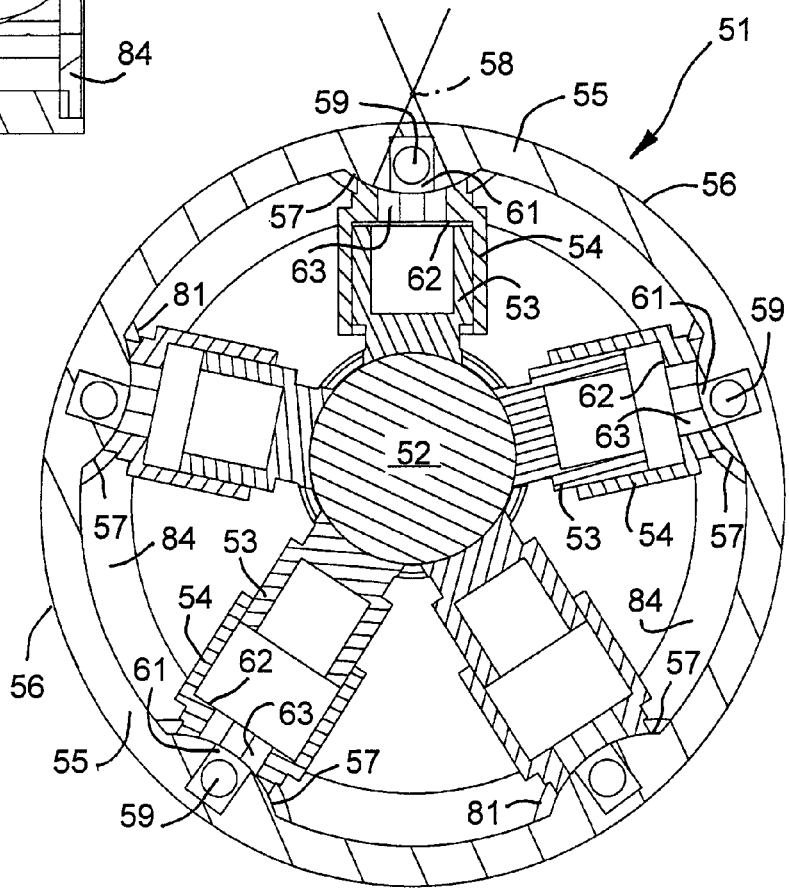
FIG. 6 represents a schematic view of a simplified diametral section VI-VI of the hydraulic motor in FIG. 5.
Figure 12:
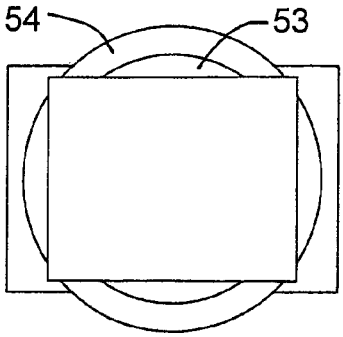
FIG. 12 represents a schematic view of the cylinder-piston group, of the third form of construction, seen in direction XII of FIG. 7.
Figure 9:
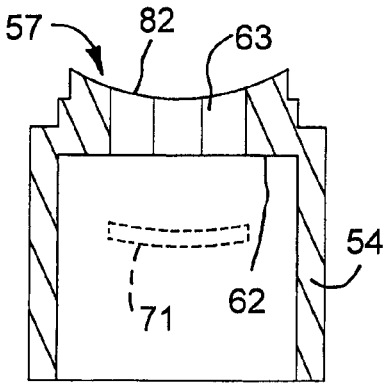
FIG. 9 represents a schematic section IX-IX of FIG. 7 of the jacket and skirt of the cylinder of the hydraulic motor according to the third form of construction.
Figure 7:
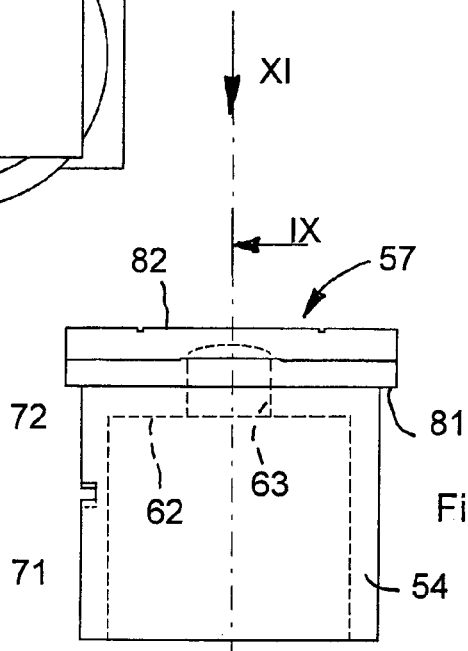
FIG. 7 represents a schematic view in the direction of the plane of oscillation of the jacket and skirt of the cylinder of the hydraulic motor according to the third form of construction in FIGS. 5 and 6.
Figure 10:
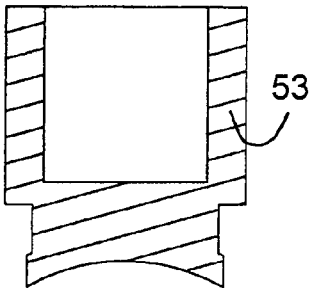
FIG. 10 represents a schematic section X-X of FIG. 8 of the piston for the cylinder-piston coupling of the third form of construction.
Figure 8:
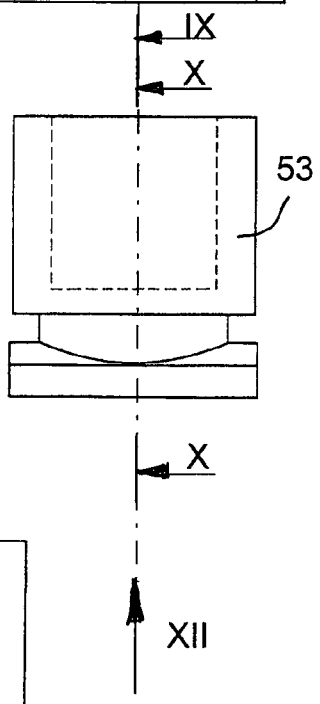
FIG. 8 represents a schematic view in the direction of the plane of oscillation of the piston of the hydraulic motor according to the third form of construction in FIGS. 5 and 6.
Figure 11:
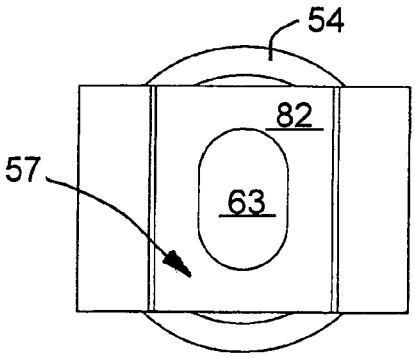
FIG. 11 represents a schematic view of the cylinder-piston group, of the third form of construction, seen in direction XI of FIG. 7.
Figure 14:
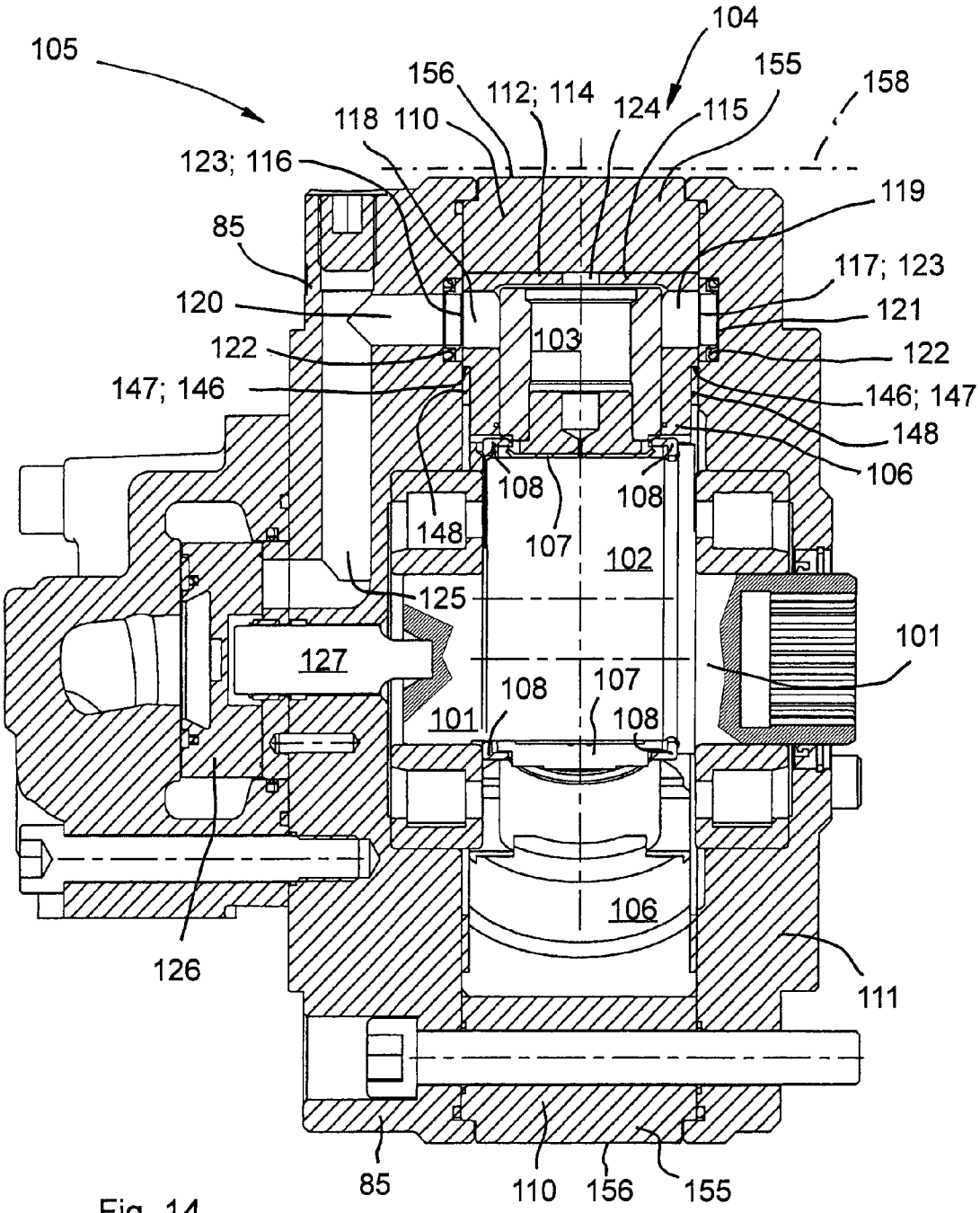
FIG. 14 represents a schematic section on a diametral plane passing through the axle of the crankshaft, in correspondence with an oscillating cylinder at the top dead centre, of a radial hydraulic motor equipped with a feed on the side of the cylinder. This is a further form of construction of the oscillating radial hydraulic cylinder, according to the present invention.
Figure 15:
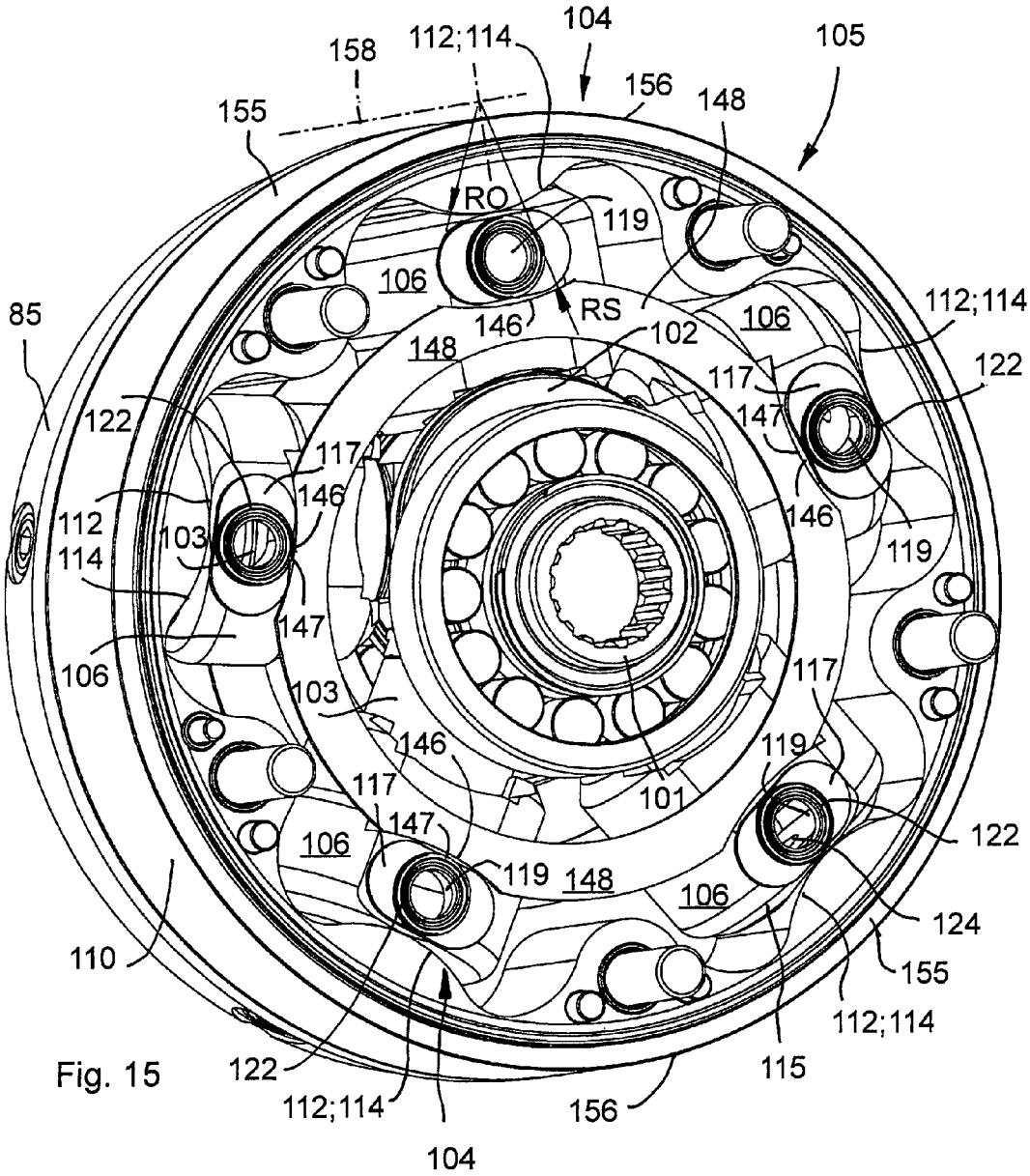
FIG. 15 represents a schematic view in perspective of the radial hydraulic motor in FIG. 14. Here it is without its cover in order to show the position of the thrust ring on the oscillating radial cylinders, for contact between the surfaces of oscillation in relation to the motor body.
Figure 18:
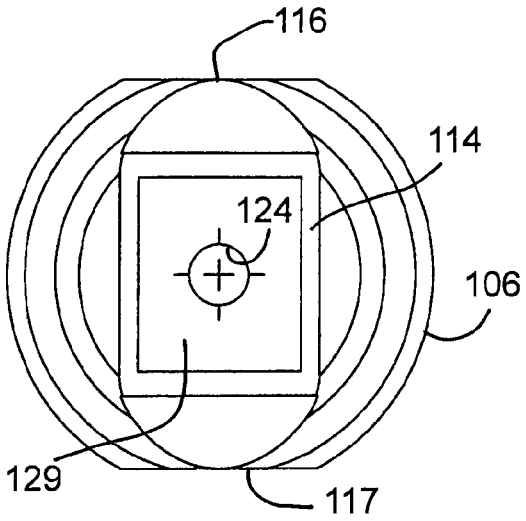
FIGS. 16, 17 and 18 are views from the side and from above of an oscillating cylinder on a cylindrical surface of oscillation of a radial hydraulic motor of FIG. 14.
Figure 17:
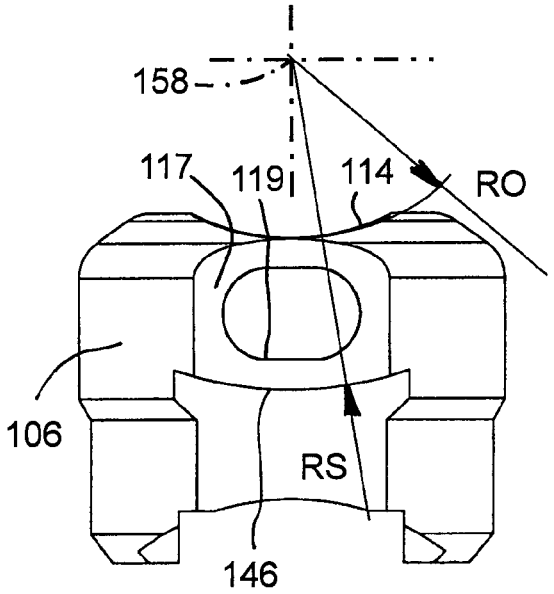
Figure 16:
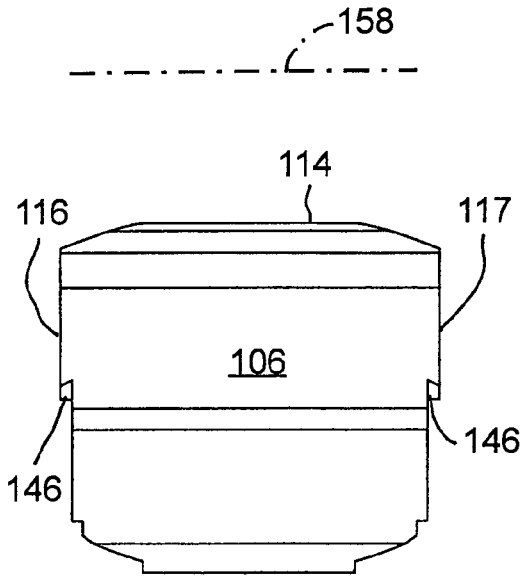

In FIGS. 5 and 6 a third radial cylinder hydraulic motor 51 with oscillating cylinders can be seen. The pistons 53 are made to slide on a crankshaft 52 and they carry out alternate motion in the cylinders 54, which are in turn made to oscillate close to the outer diameter 56 of the skirt 55 of the motor 51. They are on a cylindrical surface 57 made at the inner diameter of the said skirt and have an axis of curvature 58 external to the outer diameter 56 of the skirt 55. The cylindrical surface 57 is made directly on the skirt 55 and it is equipped with an inner axial hole 59 to complete the fluid connection with a communication channel and a distributor of hydraulic liquid, not represented here, and the opening 61 for fluid connection between the internal hole 59 and the cylinder 54 below; in the bottom plate 62 of the cylinder 54 there is an eyelet 63 to allow the complete passage of liquid even when the cylinder is tilted to the opening 61. The body 64 of the motor 51 is completed with two covers, not represented and sealed with screws, with channels for the distribution and support of the main bearings of the crankshaft, not represented here, to compete the outer skirt 55 with the cylindrical surfaces 57 made in pieces, for the oscillating cylinder-piston groups. The distributor could be a rotating disc, of the type that is well-known in the field, in synchrony with the crankshaft, or it could be a single cartridge for each group given the size of the crown of cylinder-piston groups, or other types of distributor that are well-known in the field could be used.

As can be clearly seen in FIG. 5, each cylinder 54 presents thrust devices outside the cylinder, indicated as 70, in order to maintain contact between the cylinder and the cylindrical surface 57 made in pieces. The thrust devices act on the cylinder by means of a curved indent 71, with a curvature coincidental with the axis of curvature 58 and positioned on the outer side 72 of the said cylinder. The contact between the bottom plate 62 and the cylindrical surface 57 made in pieces is maintained by inserting into the said curved indent 71 of each cylinder 54 a curved flap 43. The curved flap is of the same shape as the curved ring and it is supported by a ring 44 to maintain the respective cylinder 54 pushed up against the said cylindrical surface 57 made in pieces, during the motion of oscillation of the cylinder 54 and the relative alternate motion of the piston 53 inside it; therefore, if during motion the piston is without pressure, it does not detach from the portion of cylindrical surface of oscillation made up of the said cylindrical surface 57 which is made in pieces. The thrust ring of the curved flaps 43 is the same as the one in FIG. 13 in which the side of a part of the ring 44 can be seen as well as a flap 43, which is folded into the curvature required by the position of the axis of curvature 58 in order to push the cylinder 54 against the cylindrical surface 57 made in pieces. A different form of the thrust ring, which is used to maintain the contact between the cylinder and the cylindrical surface 57 made in pieces, presents external thrust devices on the cylinder, indicated as 80, which act on the cylinder by means of an curved outer surface 81 of the sliding pad 82 of the cylinder 54, which has a curvature coinciding with the axis of curvature 58 and positioned on the opposite side of the sliding pad 82 of the said cylinder. The contact between the bottom plate 62 and the cylindrical surface 57 made in pieces is maintained by inserting a curved flap 83 against the said curved outer surface 81 of each cylinder 54. The curved flap 83 is of the same shape as the curved outer surface and it is supported by a thrust ring at the inner diameter, which is the same as the ring 44 described, but the curved flap 83 is at the inner diameter of the thrust ring, as can be seen in FIG. 5.

In FIGS. 14-18 a further form of construction of an optimized oscillating cylinder, according to the invention, can be seen. There is a drive shaft 101 equipped with a crank or handle 102 on which the pistons 103 of the said oscillating cylinder-piston group 104 of the hydraulic motor 105 with oscillating radial cylinders 106 press. The pistons 103 are made to slide on the handle 102 in the way that is well-known by means of respective sliding pads 107 and retaining rings 108. Each oscillating cylinder 106 is coupled in oscillation with the body 110 of the hydraulic motor 105 by means of a coupling on a cylindrical surface 112 made at the inner diameter of the said skirt 155, which has an axis of curvature 158 close to the outer diameter 156 of the skirt 155. Each cylinder 106 can be adjusted axially in parallel direction to the drive shaft 101 on the cylindrical surface of oscillation 112 of the oscillating cylinder.

Each cylinder 106 presents on two outer lateral surfaces 116 and 117, parallel to each other, a supply hole 118, on the side of the parallel surface 116, and a compensating hole for the thrusts 119, on the side of the parallel surface 117. They respectively face a supply channel 120 in correspondence with the supply hole 118 in the cylinder 106 and on a compensating niche 121 in correspondence with the compensating hole 119 for the thrusts in the cylinder. The contact between the lateral, outer, parallel surface 116 of the cylinder 106 and the surface of a distribution cover 85, in the area around the supply channel 120 occurs by means of a seal ring 122 with a metal contact surface; in the same way, the contact between the lateral, outer surface 117 and the cover 111 of the body 110 of the hydraulic motor 105, on the opposite side to that of the distribution, in the area around the compensating niche 121, happens by means of an identical seal ring 122 with a metal contact surface; the sliding contact happens on sliding surfaces 123 on the covers 85 and 111 parallel to each other and perpendicular to the axis of the drive shaft 101. A hole 124 in the bottom plate 115 of the cylinder 106 supplies the cylindrical surface 112 of oscillation with hydraulic liquid for lubrification when it is in contact with the concave cylindrical surface 114 of the bottom plate of the cylinder.

In correspondence with the outer lateral surfaces 116 and 117 at the lower edges of these, there are curved steps 146 on both surfaces, which have a curvature corresponding to the cylindrical surface of oscillation 112 of the cylinder 106. These act in corresponding curved grooves 147 made on a ring 148 for each side of the cylinder-piston group. Their purpose is to maintain the contact between the cylindrical surfaces of oscillation 112, on the skirt 155, and the concave cylindrical surface 114 in the bottom plate of the oscillating cylinder 106, during start-up and when there is a lack of pressure in the liquid in the cylinder.

During completion of this form of construction, there is a supply channel 125 in correspondence with the supply channel in the cover 85. It is connected with a rotating disc distributor 126 of the type that is well-known in the field, positioned in synchronous rotation with the drive shaft 101 by means of a frontal clutch 127 which is also well-known.

Finally in the Figures which show the oscillating cylinder 106, the radius RO of curvature of the cylindrical surface of oscillation 112 and of the cylindrical concave surface 114 on the bottom plate 115 of the cylinder can be seen as well as the parts already described; furthermore, the radius of curvature RS of the curved steps 146 is clearly concentric to the radius RO of curvature of the cylindrical surface of oscillation. Therefore, in the concave cylindrical surface 114 for coupling there is a decline in order to create hydrostatic balance in the surface around the hole 124 in oscillating contact on the cylindrical surface of oscillation 112.

The seal rings 122 are composed of a ring of soft, flexible material, known as an "O ring", which is housed in a seat for each of the two lateral holes of the cylinder 106, an anti-extrusion ring and a metallic contact ring which can slide against the surfaces 116 and 117 on the side of the cylinder 106 of the hydraulic motor 105 represented.

In the first form of construction in FIGS. 1 and 2, the optimized radial hydraulic motor functions through the assembly of the sleeve 6 between the two covers 13 and 14 which determine the centers of oscillation of each group of cylinder 4 and piston 3. In order to adapt the direction of action of the thrust generated in it, the single cylinder 4 can oscillate around the axis of the sleeve 6 by means of the sliding cylindrical support surface 16 on the outer diameter 18 of the sleeve 6. The contact allows the passage of hydraulic liquid between the opening 9 and the cylinder 4 through the eyelet 11 in the bottom plate of the cylinder. Furthermore, this contact is insured under all conditions during functioning because of the cylindrical contact surface 17, i.e. even when the pressure of the hydraulic liquid in the group is low, which could cause the cylindrical support surface to detach from the outer diameter 18 of the sleeve 6. Because the cylindrical contact surface 17 is in a higher position and covers the outer diameter 18 of the sleeve 6, it prevents the support surface 16 from moving in a radial direction in relation to the said outer diameter of the sleeve 6: this technically carries out the action of undercut and insures the fluid connection between the cylinder 4 and hole 7 axial to the sleeve 6.

In the forms of construction in FIGS. 3, 4, 5 and 6, the optimized radial cylinder hydraulic motor functions through the assembly of the inserted cylindrical surface 27 on the skirt 25, as in the second form, or the creation of the cylindrical surface 57 in the construction of the skirt 55 in order to determine the centers of oscillation of each cylinder and piston group. In order to adapt the direction of action of the thrust generated in it, the single cylinder can oscillate around the axis of curvature 28, as in the second form of construction, or 58, as in the third form of construction. This happens by means of the sliding cylindrical support surface of the cylinder 24 or 54 of its surface 27 or 57. This contact allows the passage of hydraulic liquid between the opening 32, in the second form of construction, or 61, in the third form of construction, and the cylinder through an eyelet 34 or 63 in the bottom plate 33 or 62 of the cylinder 24 or 54. Furthermore, this contact is insured under all conditions during functioning because of the cylindrical contact surface 70, i.e. even when the pressure of the hydraulic liquid in the group is low, which could cause the cylindrical support surface to detach from the inserted cylindrical surface 27 on the skirt 25 or 57 made in pieces on the skirt 55. In the Figures, the thrust devices are indicated in a simple and efficient form as constituted by a ring 44 on which curved flaps 43 are made in order to bend the outer diameter of the said ring. The flaps have a curvature with a centre that coincides with the axis of curvature 28, in the second form of construction, or 58 in the third form of construction: these flaps 43 are housed in a curved indent 41 or 71 on the outer skirt of each cylinder 24 or 54, in order to prevent the support surfaces from detaching and insure fluid connection between the cylinder 24 or 54 and the axial hole 30 or 59 in the thickness behind the inserted cylindrical surface 27 or the surface in pieces 57. The ring 44 with the flaps 43 can be made from metal material for springs in order to maintain the cylinders pressed against their respective support and oscillation surfaces, as each flap reacts to the thrust of the other flaps which lean on the other cylinders of the crown. There can be variations of the ring as long as they present elasticity and partial flexibility of each curved surface of contact in the curved indent 41 or 71, made on the outer diameter of the respective cylinder.

As stated above, in FIG. 5, two different thrust devices 70 and 80 are represented. Both act by means of a thrust ring 44 or 84 on parts of the cylinder 54, the curved indent 71 or the curved outer surface 81; even only one of the two thrust devices is sufficient in order to function correctly and maintain contact between the sliding pad 82 and the portion of cylindrical surface of oscillation.

In the three forms of construction described above, the sliding of the cylinder on the outer cylindrical support surface 18, of the sleeve 6, or 27 inserted to the inner diameter of the skirt 25 or 57 and made in pieces at the inner diameter of the skirt 55, is permitted without the need for positioning on a predetermined radial plane. However, during functioning, each single group undergoes small axial displacements at the shaft without affecting the functioning of the motor and the crown of the cylinder-piston groups.

In the second from of construction, in FIGS. 3 and 4, and in the third form of construction, FIGS. 5 and 6, the position of the axis of oscillation 28 or 58 of the said cylinder-piston groups can be external to the outer diameter of the skirt 25 or 55 of the hydraulic motor. This arrangement allows the cylinder on the cylindrical surface close the skirt to slide more increasing the reciprocal sliding. Therefore sticking is avoided if the oscillation and therefore the reciprocal sliding is reduced following a reduction in the engine displacement, which happens, as is well-known, in motors with variable engine displacement.

The dimensioning of the holes 7, 30 or 59 can be carried out at the desired value in order to exploit in the best way the dimensions of the channels for fluid connection and the dimensions of the space used for the cylinder. Furthermore, a greater the radius of oscillation, obtained with positioning more towards the exterior of the axis of oscillation, 28 or 58, in relation to the skirt, allows for a greater radius of the handle and therefore increased torque on equal terms with engine displacement and the hydraulic parameters used.

Furthermore, in the fourth form of construction, the combination of the cylindrical surface of oscillation of the cylinder piston group with the feed on the side of the cylinder, allows for a significant reduction of the radial dimensions. Therefore, on the basis of this radial dimensioning it is possible to have a radial oscillating cylinder hydraulic motor with an engine displacement that is significantly greater than what known technology offers.

The advantages obtained from an optimized radial hydraulic motor, according to the invention, can be summarized as follows. The optimized radial hydraulic motor generally better exploits the space allowed i.e. with a greater engine displacement. The user of an optimized radial hydraulic motor can even house it in narrow spaces in the application required. The performance of the motor equals that of other heavier and bulkier motors. Finally, the formation n of the optimized radial hydraulic motor, in which the surfaces of oscillation of the cylinder, in the cylinder-piston group according to the invention, occurs on a cylindrical rather than spherical surface. The axial position of the group is not necessary, but can present slight axial sliding on the cylindrical support surface close to the skirt and on the usual cylindrical surface on the button of the crank or eccentric shaft on the drive motor.

Furthermore, the arrangement of the supply channels for hydraulic liquid to the respective cylinder is more homogeneous and functional. There can therefore be increases in the section for the passage of the said channels or, if desired, the channels can pass side by side through different cylinders when there are two crowns or stars of cylinders side by side. This allows for the use of a single distributor in order to contain the over-all dimensions of the motor.

The channels 7, 30, 59, 120 from the distributor to the individual cylinders have a reduced length. The same axial channels can also be extended to supply the radial cylinders, or individual axial channels in phase for each cylinder of a star and the adjacent cylinder of a star side by side with the first can be used; the latter solution where the stars of radial cylinders are not in phase creates greater uniformity of the torque on the way out of the hydraulic motor.

The thrust devices on the cylinder 40, 70 or 80 in the second or third form of construction described, maintain the contact of the cylinder 24 or 54 even when there is no or negative pressure in the motor; in the first form of construction the cylindrical contact surface 17 maintains contact with the bottom plate to create the effect of undercut. It is in opposition to the cylindrical support surface 16 of the bottom plate 10 of cylinder 4 on the sleeve 6, compared to the outer diameter 18 of the sleeve.

In the fourth form of construction, the thrust devices work in the same way as in the other forms. The presence of two rings 148, one on each side of the cylinder 106 insures a reduction of the dimensions as the rings are thinner and a possible cylinder application with a larger cylinder bore which increases the engine displacement without increasing the radial dimensions.

The thrust rings 44, 148, advantageously, are made of metal material for springs.

It is clear that a technician in the field, whose objective is to satisfy specific demands in certain situations, will be able to make numerous adjustments to an optimized radial hydraulic motor. All of these adjustments, however, will come into the area that protects the present invention which is defined in the following claims. Although it would be less beneficial the first form of construction of the radial hydraulic motor could be made with thrust devices 40, as illustrated for the other two forms of construction. The said thrust devices differ from the ring 44 or 84 with folded flaps 43 or 83 illustrated, but will operate in the same way, i.e. they remain positioned in respective curved indents 41 or 71 and push the cylinder against the cylindrical support and oscillation surface to react in relation to the other parts of the thrust device. Furthermore, the form of the thrust ring 44 or 84, and their corresponding arched flaps 43 or 83, can differ from what is represented, but will function in the same way: it pushes parts of the cylinder 24 or 54 against the portion of cylindrical surface of oscillation causing reaction on the other cylinders and relating parts on which similar flaps, as represented lean. Finally, the thrust devices composed of curved strikers 147 against curved steps 146 on each cylinder 106 can also be applied to the preceding forms of construction of a radial hydraulic motor as they result in decreased dimensions and more secure contact the cylindrical surface of oscillation and the corresponding cylindrical support surface on the bottom plate of the cylinder.

The invention claimed is:

1. A radial cylinder hydraulic motor comprising:

a plurality of cylinder-piston groups comprising a plurality of pistons and a plurality of oscillating cylinders, and in proximity to an outer skirt of the cylinder-piston groups, the pistons slide on a shaft, and create alternate motion in the oscillating cylinders, wherein a respective surface of oscillation for each cylinder of the groups, in proximity to the outer skirt, is constituted by a portion of a cylindrical surface with an axial direction parallel to an axis of rotation of the shaft and positioned in a part of the outer skirt including a diametral plane of the cylinder-piston groups, wherein a contact between a cylindrical support surface of a bottom plate of each cylinder on the portion of a cylindrical surface of oscillation happens because of the thrust created by a thrust device which acts on a side of the cylinders and is placed against plane surfaces of sliding walls that are parallel to each other and to the diametral plane of said cylinder-piston groups, and wherein the thrust device, on the cylinder for the contact, comprises a ring equipped with flaps or grooves which are curved, in relation to the axis of curvature of the portion of a cylindrical surface of oscillation of each cylinder, according to a respective radius of curvature on the thrust device, the ring urging all cylinders of the cylinder-piston groups.

2. A radial cylinder hydraulic motor, according to claim 1, wherein the thrust device comprises a pair of rings, each ring in the pair of rings acting on a side of the cylinders.

3. A radial cylinder hydraulic motor, according to claim 2, wherein the ring of the thrust device comprises a metal material for springs.

4. A radial cylinder hydraulic motor, according to claim 1, wherein the portion of cylindrical surface of oscillation of the cylinder is formed in proximity to the inner diameter of the skirt.

5. A radial cylinder hydraulic motor, according to claim 4, wherein the axis of curvature of the portion of cylindrical surface of oscillation of each cylinder is in a position external to the outer diameter of the skirt.

6. A radial cylinder hydraulic motor, according to claim 4, wherein the axis of curvature of the portion of cylindrical surface of oscillation of each cylinder is in an internal position, but next to the outer diameter of the skirt.

7. A radial cylinder hydraulic motor, according to claim 1, wherein a passage of hydraulic liquid to and from the cylinder in order to achieve supply and discharge from the cylinder, happens through a lateral outer surface on a side of the cylinder from and towards a supply channel on a lateral cover of the hydraulic motor, wherein a seal ring equipped with a contact surface, which is resistant to abrasion on a surface of the sliding walls, is interposed between the lateral outer surface in contact for the passage of the liquid under pressure.

8. A radial cylinder hydraulic motor, according to claim 7, wherein in an external lateral surface parallel to and opposite the lateral surface to the oscillating cylinder crossed by the liquid supply, there is a compensation opening for the thrust, supplied by the liquid under pressure in the oscillating cylinder, and wherein around the compensation opening is a seal ring equipped with at least one contact surface that is resistant to abrasion on the surface of the wall used for sliding, the seal ring being placed between the lateral surfaces in contact for the passage of liquid under pressure through the compensation opening.

9. A radial cylinder hydraulic motor, according to claim 8, wherein a surface of action of the pressure in the said compensation opening for the thrust is slightly greater than the surface for the passage of liquid under pressure in a supply hole present in the cylinder.

10. A radial cylinder hydraulic motor, according to claim 7, wherein the seal ring in sliding contact between a lateral surface external to the oscillating radial cylinder and a lateral sliding surface of the cylinder is constituted by an arrangement of parts in which a metal ring functions as the surface that is resistant to abrasion, present on the side of the retainer in contact with the sliding surface of the retaining ring; a ring made from soft, flexible material is interposed between the metal ring and the seat in which the retaining ring is housed; and an anti-extrusion ring is placed between the metallic ring and the soft, flexible ring in order to avoid its discharge due to the pressure of the liquid during operation.

* * * * *